United States Patent [19]

Suits

[11] 4,023,965

[45] May 17, 1977

[54] NI-FE-RH ALLOYS

[75] Inventor: James Carr Suits, Saratoga, Calif.

[73] Assignee: International Business Machines Corporation, Armonk, N.Y.

[22] Filed: June 3, 1976

[21] Appl. No.: 692,609

[52] U.S. Cl. ..... 75/170

[51] Int. Cl.[2] ..... C22C 19/03

[58] Field of Search ..... 75/170; 148/31.55

[56] References Cited

UNITED STATES PATENTS

| | | | |
|---|---|---|---|
| 3,067,029 | 12/1962 | Gyorgy et al. | 75/170 |
| 3,140,942 | 7/1964 | Walter | 75/122 |
| 3,519,498 | 7/1970 | Ahn | 148/31.55 |
| 3,540,864 | 11/1970 | Flur et al. | 29/195 |

FOREIGN PATENTS OR APPLICATIONS

| | | |
|---|---|---|
| 2,063,694 | 7/1971 | France |
| 1,125,690 | 8/1968 | United Kingdom |

OTHER PUBLICATIONS

Bradley, "Properties of Magnetic Films for Memory Systems", Journal of Applied Physics, vol. 33, pp. 1051–1057, (Mar. 1962).

Rice et al., "Magnetic Corrosion, and Surface Properties of Ni–Fe–Cr Thin Films", Journal of Applied Physics, vol. 47, pp. 1158–1163, (Mar. 1976).

Suits, "Rhodium Alloy Permalloy", IBM Technical Disclosure Bulletin, vol. 18, No. 2, p. 529, (July 1975).

*Primary Examiner*—L. Dewayne Rutledge
*Assistant Examiner*—E. L. Weise
*Attorney, Agent, or Firm*—Joseph E. Kieninger

[57] ABSTRACT

Permalloy type alloys containing rhodium suitable for use in magnetic devices and having improved resistance to corrosion contain from about 65 to 90 atomic percent nickel, 10 to 35 atomic percent iron and 1 to 25 atomic percent rhodium. Magnetic films made of these alloys which contain 1 to 10 atomic percent rhodium exhibit magnetic properties similar to Permalloy while having increased resistance to corrosion.

4 Claims, No Drawings

NI-FE-RH ALLOYS

FIELD OF INVENTION

This invention relates to magnetic compositions and more particularly to Permalloy type magnetic films containing rhodium.

BRIEF DESCRIPTION OF PRIOR ART

Magnetic thin films of Permalloy containing about 80% nickel and 20% iron are finding wide application as computer storage elements and in bubble domain devices. In certain of these applications areas it has been determined that the Permalloy thin films require additional protection against atmospheric corrosion.

The addition of a third metal to Permalloy has been widely investigated in order to alter the properties thereof. The patent to Griest et al, United Kingdom 1,125,690 and assigned to the assignee of the present application discloses the addition of 1 to 12 atomic percent palladium to Permalloy to obtain a film with zero magnetostriction.

The work of E. M. Bradley published in the Journal of Applied Physics, supplement to Volume 33 (March 1962) pp 1051–1057, discloses the properties of nickel-iron-cobalt films. The nickel-iron-cobalt films compared to the films of simple binary Permalloy show higher values of wall motion coercive force and anisotropy field.

The patent to Flur et al, U.S. Pat. No. 3,540,864 and assigned to the assignee of the present application describe an alloy containing Permalloy and 3 to 20 weight percent manganese in order to form a magnetic field which is not magnetostrictive.

The work of Rice, Suits and Lewis published in the Journal of the Applied Physics, Vol. 47, No. 3, March 1976, pp. 1158–1163 entitled "Magnetic, Corrosion, and Surface Properties of Ni-Fe-Cr Thin Films", describes the corrosion, surface and magnetic properties of Permalloy films containing chromium therein. While chromium did reduce the corrosion of Permalloy type alloys, the magnetization and the magnetoresistance of the resultant alloy were reduced rapidly.

SUMMARY OF THE INVENTION

It is the primary object of this invention to provide an improved alloy.

It is another object of this invention to provide a Permalloy type alloy having improved corrosion resistance.

It is still another object of this invention to provide a corrosion resistant alloy having suitable magnetic properties for use in bubble domain devices.

It is yet still another object of this invention to provide a corrosion resistant alloy having magnetic properties suitable for use in thin film inductive heads and thin film magnetoresistance heads for magnetic disks.

These and other objects are accomplished by an alloy having the following composition.

$$(Ni_aFe_{100-a})_{100-x}Rh_x \qquad (1)$$

where $a$ is 65 to 90 atomic percent $x$ is 1 to 25 atomic percent

A preferred embodiment contains $(Ni_{81}Fe_{19})_{95}Rh_5$. This composition is substantially more resistant to corrosion than is Permalloy. In addition, the magnetization and the coercive force have not changed significantly.

Other objects of this invention will be apparent from the detailed description wherein various embodiments of the invention are described.

DESCRIPTION OF THE ILLUSTRATIVE EMBODIMENTS

The addition of 1 to 25 atomic percent rhodium to nickel-iron Permalloy type compositions increases the corrosion resistance of these compositions substantially. At the same time the magnetic properties of these compositions such as the magnetization, $4\pi M$, and the coercive force, $H_c$, change relatively slowly with rhodium addition, particularly at concentrations of 1 to 10 atomic percent rhodium.

The nickel-iron-rhodium thin films may be prepared by simultaneous evaporation from a two source system. One source is a resistance heated berylia crucible containing a Permalloy ingot. The second source is an electron beam gun source containing an ingot of rhodium. During deposition of the new alloy the vacuum is about $10^{-6}$ Torr. The deposition rate is about 180 angstroms per minute and the substrate temperature is about 200° C. The films can be deposited on fused quartz or float glass substrates. The film thickness may vary from 300 to 20,000 angstroms. The thickness of the film will depend upon the intended application.

EXAMPLE 1

A Ni/Fe (Permalloy type) ingot having an atomic ratio of 83/17 was evaporated from a resistance heated berylia crucible. Rhodium was evaporated from an ingot in an electron gun source at the same time as the Permalloy type ingot was evaporated. The deposition was carried out for a period of about 4 to 5 minutes in a vacuum of $10^{-6}$ Torr. The temperature of the fused quartz substrate was about 200° C. An electron beam microprobe analysis of the deposited film showed that the Ni/Fe ratio in the deposited film was about 81/19 (Permalloy). The deposition of the two sources were controlled to provide a film having 5.0 atomic percent rhodium therein. The thickness of the film was about 755 angstroms. The magnetization, $4\pi M$, was measured and found to be 8.43 kG. The coercive force, $H_c$, was determined to be 1.6 Oersted. Both the magnetization and the coercive force values for this film are suitable for most applications since the difference between these values and the values obtained for Permalloy are not significant. The corrosion of this film was compared to the corrosion of a standard permalloy film. The samples were placed in a corrosion chamber containing 300ppb $SO_2$, 480ppb $NO_2$, 170ppb $O_3$, 15ppb $H_2S$, 3ppb $Cl_2$ and 70% relative humidity for a period of 24 hours. The corrosion was monitored by measuring the electrical resistance increase of the film as the film corrodes. The corrosion rate was reduced from about 1.8 angstroms per hour for rhodium-free Permalloy to 0.08 angstroms for this film containing the rhodium.

EXAMPLES 2 to 22

The same procedure as described in Example 1 was used on Examples 2–22. The Ni/Fe ratio in all of these thin films was about 81/19. Examples 2–22 had an atomic percent rhodium concentration ranging from 1.2 to 34 and the results are tabulated in the following table.

| Ex. | at % Rh | Film Thickness, A° | 4πM, kG | Hc, Oe | ρ/ρ,% | Corrosion Rate,A°/hr. |
|---|---|---|---|---|---|---|
| A-1 | 0 | 720 | 8.45 | 1.1 | 2.2 | 3.1 |
| A-2 | 0 | 755 | 7.94 | 1.6 | — | 1.1 |
| A-3 | 0 | 1010 | 8.40 | — | — | 1.28 |
| A-4 | 0 | 1790 | 8.86 | — | — | 1.92 |
| 2 | 1.2 | 570 | 7.11 | 1.4 | 1.4 | 1.4 |
| 3 | 1.2 | 510 | 8.40 | 1.7 | — | 0.75 |
| 4 | 2 | 1630 | 8.65 | 1.3 | — | 0.64 |
| 5 | 2.5 | 680 | 8.95 | 1.9 | 1.1 | 0.23 |
| 6 | 2.5 | 680 | 7.73 | 1.7 | — | 0.29 |
| 7 | 4.0 | 1530 | 8.55 | 1.7 | — | 0.72 |
| 8 | 4.5 | 630 | 9.81 | 1.4 | 0.8 | 0.13 |
| 9 | 4.5 | 675 | 8.84 | 1.7 | — | 0.23 |
| 1 | 5.0 | 755 | 8.43 | 1.6 | 0.6 | 0.08 |
| 10 | 5.0 | 770 | 7.70 | 2.4 | — | 0.21 |
| 11 | 6 | 1170 | 7.28 | 1.9 | — | 0.07 |
| 12 | 6 | 1460 | 8.40 | 1.3 | — | 0.41 |
| 13 | 6 | 1660 | 7.78 | 1.2 | — | 0.54 |
| 14 | 8 | 1020 | 6.97 | 1.9 | — | 0.03 |
| 15 | 8 | 1440 | 7.43 | 1.5 | — | 0.47 |
| 16 | 8 | 1830 | 8.11 | 1.3 | — | 0.64 |
| 17 | 10 | 1390 | 5.44 | 1.8 | — | 0.54 |
| 18 | 10 | 1760 | 8.64 | 1.2 | — | 0.27 |
| 19 | 20 | 1200 | 6.79 | 3.0 | — | 0.10 |
| 20 | 21 | 920 | 5.15 | 4.3 | — | 0.09 |
| 21 | 34 | 995 | 0.55 | — | — | — |
| 22 | 34 | 985 | 0.46 | — | — | 0.01 |

Bulk samples of Permalloy-Rhodium alloys have been fabricated according the formula $(Ni_{78}Fe_{22})_{1-00-x}Rh_x$ where $x$ is 10, 20 and 30. Atmospheric corrosion was found to be substantially less for these alloys than Permalloy without the rhodium. The magnetization, 4πM, decreased as the percentage of the rhodium increased and the 30% rhodium sample was greatly reduced over the rhodium-free Permalloy sample. These data are published in the IBM Technical Diclosure Bulletin, Vol. 18, No. 2, July 1975 on p. 529 and are incorporated herein by reference thereto.

Small additions of rhodium to Permalloy induces substantial resistance to atmospheric corrosion since a beneficial effect is noted when 1.2 to 2.5 atomic percent rhodium is incorporated in the Permalloy (Examples 2–6). The magnetization, 4πM, drops very slowly with the rhodium addition as it is primarily a diluent effect. For concentrations of up to 10 atomic percent rhodium the coercive force $H_c$ remains low, that is below 2 Oersteds, and not significantly higher than pure Permalloy. For many applications 1 to 10 atomic percent rhodium in the Permalloy-rhodium alloy is a useful range. Other applications having less stringent magnetization and coercive force requirements could utilize alloys containing 10 to 25 percent atomic rhodium. A preferred composition contains 5 atomic percent rhodium 77 atomic percent nickel and 18 atomic percent iron, $[(Ni_{81}Fe_{19})_{95}Rh_5 = Ni_{77}Fe_{18}Rh_5]$ which provides good resistance to atmospheric corrosion, good magnetization, and reasonable coercive force values.

It is understood that the nickel-iron ratio in Permalloy can be varied within the ranges set forth above in the formula to alter the magnetic parameters. The preferred nickel concentration in the rhodium Permalloy alloy (see Equation 1) is between 75 to 85 atomic percent. The preferred iron concentration, 100-$a$, in the rhodium Permalloy alloy is 15 to 25 atomic percent.

Although preferred embodiments have been described, it is understood that numerous variations may be made in accordance with the principles of this invention.

I claim:

1. An improved corrosion resistant ferromagnetic composition comprising $$(Ni_aFe_{100-a})_{100-x}Rh_x$$

where $a$ is 65 to 90 atomic percent $x$ is 1 to 25 atomic percent.

2. A composition as described in claim 1 wherein $x$ is 2 to 10%.

3. A composition as described in claim 1 wherein $x$ is 4 to 6%.

4. A composition as described in claim 1 wherein $a$ is 75 to 85 atomic percent.

* * * * *